US005288343A

United States Patent [19]

Yazawa et al.

[11] Patent Number: 5,288,343

[45] Date of Patent: Feb. 22, 1994

[54] STAINLESS STEEL SHEET FOR EXTERIOR BUILDING CONSTITUENT

[75] Inventors: Yoshihiro Yazawa; Yuji Sone; Keiichi Yoshioka, all of Chiba; Noboru Kinoshita, Tokyo; Masayuki Hino, Kobe, all of Japan

[73] Assignee: Kawasaki Steel Corporation, Kobe, Japan

[21] Appl. No.: 982,021

[22] Filed: Nov. 24, 1992

Related U.S. Application Data

[60] Continuation of Ser. No. 670,708, Mar. 18, 1991, abandoned, which is a division of Ser. No. 495,345, Mar. 19, 1990, Pat. No. 5,019,181.

[30] Foreign Application Priority Data

Mar. 17, 1989 [JP] Japan ..... 1-63891

[51] Int. Cl.[5] ..... C22C 38/18

[52] U.S. Cl. ..... 148/325; 148/326

[58] Field of Search ..... 148/325, 326, 607, 608

[56] References Cited

U.S. PATENT DOCUMENTS

| | | | |
|---|---|---|---|
| 3,065,119 | 11/1962 | Brautigam | 148/326 |
| 3,347,663 | 10/1967 | Bieber | 148/326 |
| 4,374,683 | 2/1983 | Koike et al. | 148/325 |
| 4,726,853 | 2/1988 | Gressin et al. | 148/325 |
| 4,964,926 | 10/1990 | Hill | 148/325 |

FOREIGN PATENT DOCUMENTS

| | | | |
|---|---|---|---|
| 0225263 | 6/1987 | European Pat. Off. . | |
| 55-69218 | 5/1980 | Japan | 148/607 |
| 2-310318 | 12/1990 | Japan | 148/608 |

*Primary Examiner*—Deborah Yee

*Attorney, Agent, or Firm*—Dvorak and Traub

[57] ABSTRACT

A sheet metal made from a ferritic stainless steel alloy which has an improved corrosion resistivity and is suitable for use in manufacturing exterior building material, in particular, roofing material, by means of forming process such as roll-forming, without formation of pocket wave. The steel alloy comprises 10–32 wt % of Cr and 0.005–0.1 wt %, in total, of C and N, the balance being Fe and unavoidable impurities. The sheet metal has been processed to present a mechanical property that, when tested in a tensile test conducted for a test piece sampled in the widthwise direction of cold-rolling and measured at the elastic limit reached in the test, a strain ratio is equal to or greater than 2.5.

The method of making the sheet metal comprises the steps of: cold rolling a steel slab into a sheet metal, subjecting the thus obtained sheet metal to final annealing, subjecting the sheet metal to skin-pass rolling, and, subjecting the resulting sheet metal to aging process at a temperature of 200°–550° C. for a time period of more than 5 seconds and less than 48 hours.

6 Claims, 3 Drawing Sheets

STAINLESS STEEL SHEET FOR EXTERIOR BUILDING CONSTITUENT

This application is a continuation of application Ser. No. 07/670,708, filed Mar. 18, 1991, now abandoned, which is a division of U.S. Ser. No. 07/495,345, filed Mar. 19, 1990, now U.S. Pat. No. 5,019,181.

BACKGROUND OF THE INVENTION

1. Field of the Invention

The present invention relates to stainless steel sheets suitable for use as exterior building materials and methods of manufacturing the same. The present invention is particularly applicable to light-gauge stainless steel sheets having a wall thickness of less than about 0.8 mm and which may be subjected to forming process such as press-forming and roll-forming to manufacture roofing materials having a relatively large surface area.

2. Description of the Prior Art

Hitherto, stainless steel sheets have been used to manufacture exterior building materials, such as sashes, curtain walls and building panels. Generally, stainless steel sheet products for such applications are of a relatively limited surface area.

Recently, stainless steel sheets have found new application as roofing materials, in view of their superior corrosion-resistant weatherproof capability and due to the developments of in-situ forming and roofing technics.

When intended for final use as roofing materials, the stainless sheets are subjected, at any point of time prior to roofing and at any suitable location, to forming process to shape the sheets into desired roofing elements which are mostly in the form of a flanged channel section. To this end, a roll-forming mill, for example, is conveniently installed in the building site and is operated to roll-form the stainless sheet metal into channel-shaped roofing element by bending the sheet metal along the desired bending lines.

Therefore, the material of the stainless steel sheets must exhibit sufficient workability to permit forming. Austenitic stainless steel alloy such as JIS SUS304 stainless steel alloy (18Cr-8Ni) is known as a steel alloy having adequate workability for these purposes and, for this reason, has currently been used to produce stainless steel sheets for roofing materials.

The primary problem with the conventional stainless steel sheets is related to the use of austenitic stainless steel alloy. The production cost is increased because austenitic stainless steel alloy contains a large amount of Ni which is quite expensive. This tends to limit the market of stainless steel sheets as intended for use as exterior building materials, particularly roofing materials.

Another problem with the conventional stainless steel sheets is concerned with the requirement for coating. Currently, stainless steel sheets used for roofing materials are coated with colored coatings. Obviously, this is because it has been believed in the industry that coating of stainless steel sheets is as well necessary in order to avoid the problem experienced with the conventional zinc-plated sheet-iron roof that, once a default occurs in the zinc layer due to deterioration thereof, the underlying sheet iron is subjected to intensive pitting corrosion so that the roof becomes inoperative shortly thereafter due to leakage of rain. In this respect, it has often been pointed out and criticized that investments for expensive stainless steel roof would not be warranted in so far as no one could visually recognize by way of appearance the use of stainless steel sheets as they are concealed by the coating layer applied thereon.

In view of the foregoing, it is desirable that roofing materials made from stainless sheet metal be offered for service in a condition in which the use of stainless steel sheets can readily be visually recognized. In addition, it is desirable to use stainless steel alloy of the class which does not contain expensive Ni. These requirements would be met by making the stainless sheet metal from a ferritic stainless steel alloy and by using the sheet metal as such, i.e., without coating, to provide exterior building materials such as roofing materials.

However, the primary problem which must be overcome in successfully manufacturing the exterior building materials such as roofing materials with the ferritic stainless steel sheets is the formation of "pocket wave" during the forming process. A pocket wave may be defined as a concave depression or convex projection formed on the otherwise flat bottom or side wall of the formed sheet metal product when a sheet metal blank is subjected to forming process, such as roll forming and press forming.

The formation of the pocket wave is related to the workability of the material forming the sheet metal. In the case of the conventional stainless steel sheets made from an austenitic stainless steel alloy, the formation of pocket wave has not been observed to any appreciable degree since the austenitic stainless steel alloy inherently exhibits adequate workability. In contrast, with the currently available stainless steel sheet made from a ferritic stainless steel alloy, there is a tendency of pocket waves being formed to a nonnegligible degree. This is intolerable particularly when the stainless steel sheet products are used as roofing materials having a relatively large surface area, because waving of the roof surface due to the presence of the pocket waves on respective roofing elements impairs the attractive appearance of the roof.

Another disadvantage of the currently available sheet metal made from a ferritic stainless steel is that it has poor corrosion resistivity as compared with the austenitic stainless steel. In order to successfully utilize the uncoated ferritic stainless steel sheets as exterior building materials, particularly roofing materials, it is necessarily required that the stainless steel sheets exhibit the outdoor weatherproof capability and corrosion resistivity sufficient to withstand formation of red rust and pitting corrosion for more than 10 years. This is particularly true when the buildings are located in the coastal regions and, therefore, are subjected to saline environment in which airborne saline particles tend to adhere to the roof surface and intensively attack the roofing materials by way of pitting corrosion.

SUMMARY OF THE INVENTION

An object of the invention is to provide a stainless steel sheet made from ferritic stainless steel alloy and which has an improved workability.

Another object of the invention is to provide a stainless steel sheet of ferritic stainless steel alloy which may be subjected to forming process such as roll-forming and press-forming without formation of the pocket wave.

Still another object of the present invention is to provide a stainless sheet metal made from ferritic stainless steel alloy and which has improved corrosion resistivity and weatherproof durability.

A further object of the invention is to provide a sheet metal of ferritic stainless steel alloy which is suitable for use as exterior building materials, particularly roofing materials, and which may be used in uncoated condition under a saline environment for an extended period of time.

Another object of the present invention is to provide a method of manufacturing a stainless steel sheet made from ferritic stainless steel alloy and having one or more of the characteristics just mentioned.

Another object of the invention is to provide a method of manufacturing ferritic stainless steel sheets suitable for use as exterior building materials which may be performed by steps including the conventional cold rolling.

According to the invention, there is provided a stainless sheet metal suitable for exterior building materials. One feature of the invention is that the sheet metal is made from a ferritic stainless steel alloy comprising 10–32 wt % of Cr and 0.005–0.1 wt %, in total, of C and N, the balance being Fe and unavoidable impurities. Another feature of the invention is that the sheet metal has been processed under conditions such that, when tested in a tensile test conducted for a test piece sampled in the widthwise direction of cold-rolling and measured at the elastic limit reached in the test, the sheet metal presents a ratio of the amount of strain (elongation) as measured in the direction of tension on the test piece with respect to the amount of strain (compression) as measured in the widthwise direction of the test piece (hereinafter referred-to in the specification and the appended claims as the strain ratio) which is equal to or greater than 2.5.

Preferably, the ferritic stainless steel alloy further comprises at least one element selected from the group consisting of 0.2–3.5 wt % of Mo, 0.1–3.0 wt % of Cu, 0.1–0.9 wt % of Nb, and 0.15–1.0 wt %, in total, of Ti, V, Zr, and B.

According to another aspect of this invention, there is provided a method of making a stainless steel sheet for exterior building materials, the sheet being made from a ferritic stainless steel alloy comprising 10–32 wt % of Cr, and 0.005–0.1 wt %, in total, of C and N, the balance being Fe and unavoidable impurities. According to the invention, the method comprises the steps of: cold rolling a steel slab into a sheet metal; subjecting the thus obtained sheet metal to final annealing; subjecting the sheet metal to skin-pass rolling; and, subjecting the resulting sheet metal to aging process at a temperature of 200°–550° C. for a time period of more than 5 seconds and less than 48 hours.

Here, again, the ferritic stainless steel alloy may preferably comprise at least one element selected from the group consisting of 0.2–3.5 wt % of Mo, 0.1–3.0 wt % of Cu, 0.1–0.9 wt % of Nb, and 0.15–1.0 wt %, in total, of Ti, V, Zr, and B.

DESCRIPTION OF THE PREFERRED EMBODIMENTS

The present invention will now be described in more detail with reference to the preferred embodiments thereof. First, the mechanical property of the stainless sheet metal according to the invention will be described in relation to the mechanism of formation of the pocket wave.

Generally, sheet metal or strip of ferritic stainless steel may be manufactured by subjecting a steel slab to hot rolling, annealing, pickling, cold rolling performed in a single pass or in two passes interposed by intermediate annealing, final annealing, and surface finishing or temper rolling which is known as skin-pass rolling.

Figure 1:
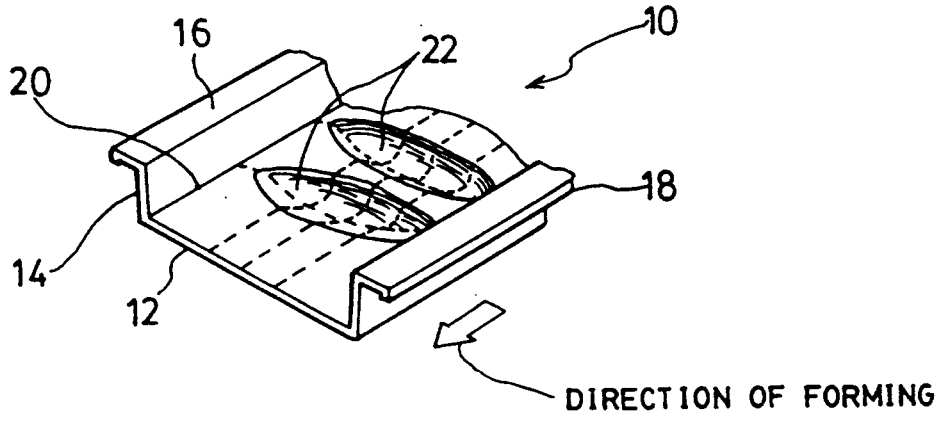
FIG. 1 is a perspective view showing a part of a roofing element prepared by roll-forming and illustrating the pocket waves as formed on the bottom wall of the element.

To facilitate handling and transportation, the product may preferably be shipped from the steel making factory to the building site in the form of a coil of strip which is thereafter cut into sheet metals. The sheet metal may then be formed into a roofing element by roll-forming mill or press-forming equipments installed in the building site. As shown in FIG. 1, each roofing element 10 may be channel shaped and may typically comprise a bottom wall or web 12, a pair of upright side walls 14, and a pair of horizontal flanges 16 with turned-down ends 18. These portions 14, 16 and 18 together serve as a coupling section for mechanically connecting the adjacent roofing elements with each other. When roll-forming mill is used for forming, the sheet metal is passed through the mill in the direction shown by the arrow in FIG. 1. The portions 14, 16 and 18 are formed by bending the sheet metal along the required bending lines one of which is shown in FIG. 1 at 20.

Figure 2:
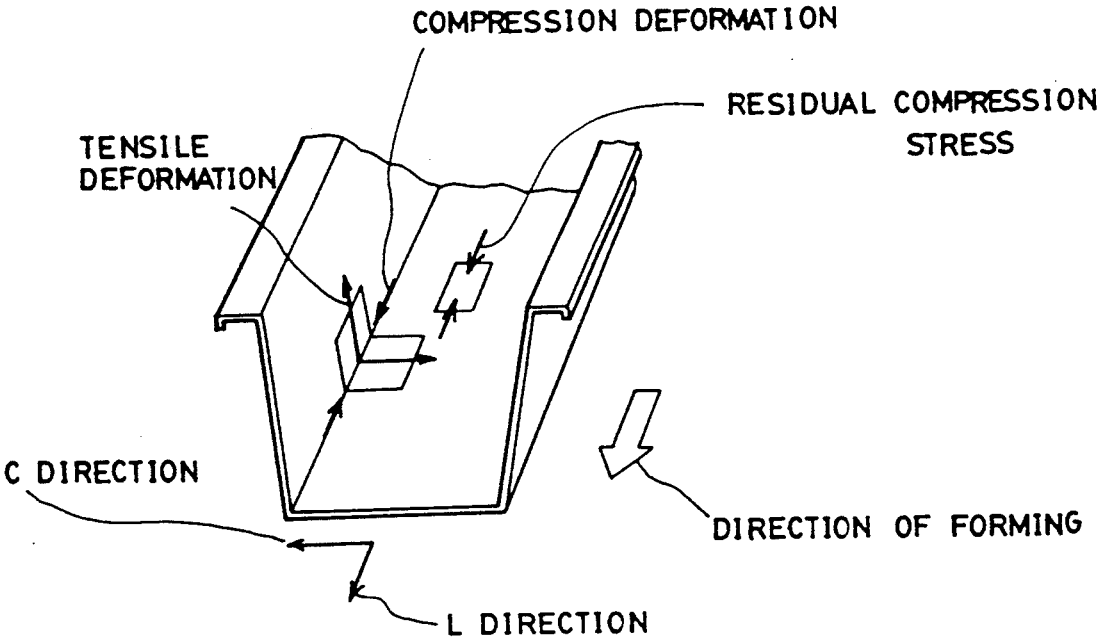
FIG. 2 is a schematic view illustrating the mechanism of the pocket wave formation; and, FIGS. 3 and 4 are graphs showing the results of experiments conducted to ascertain the effects of aging with respect to the condition of aging, with FIG. 3 showing the relationship between the height of the pocket waves and the temperature of aging, with FIG. 4 showing the relationship between the height of the pocket waves and the duration of aging.

During forming, the material of the sheet metal adjacent the bending line undergoes tensile deformation (elongation) in the transverse or cross-sectional (C) direction as well as compression deformation in the longitudinal (L) direction as schematically illustrated in FIG. 2. As a result, residual tensile and compression stresses are developed in the material of the finished roofing element in the C and L directions, respectively. The material in the region adjacent the bending line will be under the strongest residual stresses but the wall in this region is free from the pocket wave formation because this region has been stiffened by bending and is, therefore, sufficiently self-sustaining. As the distance from the bending line increases, the residual stresses will decrease but the material becomes less self-sustaining. It is believed that when the residual compression stress exerted in the L direction overcomes the buckling limit of the material, the bottom wall of the channel undergoes buckling so that the pocket waves are developed as shown at 22 in FIG. 1.

The present inventors have found that the formation of the pocket waves results from the residual stresses developed in the region of the roofing element where the metal deformation during roll-forming is less than 1%. The inventors have further found that, by increasing the strain ratio, defined hereinbefore in this specification, of the sheet metal, the residual compression stress to be developed in the roofing element after roll-forming can be reduced and this contributes to prevent the formation of the pocket wave.

More specifically, the present inventors have discovered, based on extensive research and developments, that the formation of the pocket wave can substantially be suppressed or avoided if the sheet metal is manufactured under conditions such that, when tested in a tensile test conducted for a test piece sampled in the widthwise direction of cold-rolling and measured at the elastic limit reached in the test, the strain ratio of the sheet metal blank prior to roll-forming is equal to or greater than 2.5.

The present inventors have found that the strain ratio of the sheet metal product manufactured by cold-rolling process is primarily affected by the correlation between skin-pass rolling (i.e., temper rolling) and aging, but not by the draft of cold rolling. The inventors have found that the strain ratio of the sheet metal of ferritic stainless steel alloy can be made equal to or greater than 2.5 when the sheet metal is manufactured by subjecting the steel slab to hot rolling, annealing, pickling, cold rolling, final annealing, appropriate skin-pass rolling, and aging process. It is believed that aging per se acts to eventually lower the strain ratio. However, it has been discovered that the combination of skin-pass rolling and aging is effective as a whole in remarkably increasing the strain ratio.

It has been found that skin-pass rolling also contributes to enhancement of the elastic limit of the material forming the stainless sheet metal. The increase in the elastic limit is believed advantageous in eliminating the formation of the pocket wave. First, as the elastic limit of the material increases, the buckling limit of the material is increased accordingly. Furthermore, the plastic deformation which takes place during roll-forming is confined to the region adjacent the bending lines so that the residual stress in the bottom wall of the finished roofing element is reduced. As a result, the formation of the pocket wave is effectively suppressed.

According to the invention, aging is carried out at a temperature of 200°-550° C. for a time period of more than 5 seconds and less than 48 hours.

It is believed that aging at a temperature of less than 200° C. is not efficient in effectively increasing the strain ratio and the elastic limit. On the other hand, it has been observed that aging at a temperature above 550° C. tends to detract the effect of aging. Thus, it is desirable that the lower limit of temperature be 550° C.

It is believed that at least 5 seconds of aging is required to obtain the intended result. However, aging for more than 48 hours is not required as the effect of aging is saturated at 48 hours and thereafter tends to decrease.

With regard to the chemical property, it has been found that, according to the invention, the passivated layer or film formed on the surface of the sheet metal is strengthened and is made defect-free. As a result, improved corrosion resistivity and weatherproof capability are secured which are capable of withstanding pitting corrosion and rust formation that would otherwise be resulted from the attack by chlorine, sulfate, or nitrate ions contained in saline particles and acid rain. Therefore, the roof made with the stainless steel sheets of the invention may be used for an extended life of service.

According to one embodiment of the invention, the sheet metal is made from a stainless steel alloy comprising 10–32 wt % of Cr and 0.005–0.1 wt %, in total, of C and N, the balance being Fe and unavoidable impurities.

Regarding the Cr content, it is believed that at least 10 wt % of Cr is necessary in order to strengthen the passivated layer. As the Cr content increases, the steel becomes harder and the workability of forming is lowered. Therefore, it is believed that the Cr content greater than 35 wt % is not desirable.

It is considered that the total amount of C and N of at least 0.005 wt % is necessary in order to enjoy the effect of aging. However, since the workability becomes poor and the intergranular corrosion is promoted as the total content of C and N increases, it is believed that the upper limit of 0.1 wt % is desirable.

Preferably, the ferritic stainless steel alloy further comprises at least one element selected from the group consisting of 0.2–3.5 wt % of Mo, 0.1–3.0 wt % of Cu, 0.1–0.9 wt % of Nb, and 0.15–1.0 wt %, in total, of Ti, V, Zr, and B.

Mo, Cu and Nb are effective, singularly or in combination, in suppressing the formation and progress of pitting corrosion. It is believed that at least 0.2 wt % of Mo is required to suppress the progress of pitting corrosion. It seems, however, that more than 3.5 wt % of Mo is not necessary because the effect thereof is saturated at this level and the steel becomes harder and the workability of forming is lowered.

Similarly, at least 0.1 wt % of Cu is required to suppress the progress of pitting corrosion but more than 3.0 wt % of Cu is not necessary because the effect thereof is saturated at this level as well as the steel becomes harder and the workability of forming is lowered.

It is believed that at least 0.1 wt % of Nb is necessary to improve the corrosion resistivity. However, its effect is saturated with the Nb content of 0.9 wt %. Thus, the upper limit for the Nb content is 0.9 wt %.

Ti, V, Zr, and B are elements that improve the corrosion resistivity by forming carbides and nitrides. Therefore, at least 0.15 wt % in total is believed necessary. However, the total content beyond 1.0 wt % is not desirable since workability for roll-forming becomes insufficient.

EXAMPLE 1

The present inventors prepared various specimens of sheet metal from steel slabs of ferritic stainless steel alloys having different alloy compositions A–K given in Table 1 below.

TABLE 1

| ALLOY | Cr (wt %) | Mo (wt %) | Cu (wt %) | Nb (wt %) | Ti (wt %) | C + N (wt %) |
|---|---|---|---|---|---|---|
| A | 12.1 | — | — | — | — | 0.011 |
| B | 28.0 | — | — | — | — | 0.020 |
| C | 20.1 | 1.01 | — | — | — | 0.015 |
| D | 21.0 | — | 0.55 | — | — | 0.009 |
| E | 20.5 | 0.98 | 0.51 | — | — | 0.007 |
| F | 20.7 | — | — | 0.50 | — | 0.009 |
| G | 21.1 | — | — | — | 0.35 | 0.007 |
| H | 19.7 | — | — | 0.49 | 0.005 | 0.013 |
| I | 20.1 | 1.11 | — | 0.52 | — | 0.011 |
| J | 21.9 | 0.90 | 0.47 | 0.51 | — | 0.009 |
| K | 23.0 | 1.11 | 0.50 | 0.50 | 0.007 | 0.010 |

Each specimen of sheet metal was prepared by heating the steel slab at a temperature of 1,200° C. and by hot-rolling the heated slab down to a 4 mm thickness. The product was then annealed at a temperature in the range of 800°-1,100° C. and thereafter was cold-rolled into a sheet metal having a thickness of 0.6 mm. Therefore, the draft of cold-rolling was 85%. The product was then subjected to final annealing at a temperature of 800°-1,100° C. and thereafter to skin-pass rolling. The draft of skin-pass rolling was about 1%.

Then, each specimen was subjected to aging process under various conditions and was then roll-formed into a roofing element having the channel-shaped configuration as shown in FIG. 1. For the purposes of comparison, a number of specimens of sheet metal were also roll-formed without subjecting to aging after skin-pass rolling. Each of the resultant roofing elements was subjected to measurement to assess the degree of pocket wave formation.

In order to quantitatively measure the degree of the pocket wave formation, the longitudinal profile of each roofing element was first determined by scanning a displacement detector of the eddy-current type with its probe or stylus moved along the center line of the bottom wall of the channel-shaped roofing element where the pocket wave formation is most likely to occur and where the magnitude of the pocket waves is the greatest. Then, the sum of the maximum height, in the absolute value, of all the pocket waves on one element was calculated and then divided by the longitudinal length of the roofing element. Thus, the resulting data represent the height of the pocket waves per unit longitudinal length of the roofing element.

The results are shown in Tables 2–7 below, wherein Table 2 illustrates the results of a comparative experiment obtained by using the specimens of sheet metal roll-formed without being subjected to aging after skin-pass rolling, Table 3 shows the results of another comparative experiment obtained by using the specimens of sheet metal which were not subjected to aging after skin-pass rolling but underwent aging at 280° C. for one hour between successive passes of cold-rolling, and Tables 4–7 illustrate the results obtained by using the sheet metal specimens all subjected to aging after skin-pass rolling, with the condition of aging shown in Tables 5 and 6 being in accordance with the invention, the condition of aging shown in Tables 4 and 7 departing from the condition according to the invention. In Tables 2–7, the reference characters A–D used for ranking the degree of pocket wave formation represent, respectively, the following.

A: No pocket wave formation.

B: Height of pocket wave per unit length is less than 1 mm.

C: Height of pocket wave per unit length is equal to or greater than 1.0 mm but is less than 2.0 mm.

D: Height of pocket wave per unit length is equal to or greater than 2.0 mm.

TABLE 2

(COMPARATIVE EXPERIMENT)

| ALLOY | CONDITION OF AGING TEMPERATURE | CONDITION OF AGING DURATION | HEIGHT OF POCKET WAVE PER UNIT LENGTH hw [mm/m] | DEGREE OF POCKET WAVE FORMATION |
|---|---|---|---|---|
| A | (WITHOUT AGING) | | 3.5 | D |
| B | | | 3.3 | D |
| C | | | 3.2 | D |
| D | | | 3.4 | D |
| E | | | 3.0 | D |
| F | | | 3.3 | D |
| G | | | 3.4 | D |
| H | | | 3.0 | D |
| I | | | 3.1 | D |
| J | | | 2.9 | D |
| K | | | 3.0 | D |

TABLE 3

(COMPARATIVE EXPERIMENT)

| ALLOY | CONDITION OF AGING TEMPERATURE | CONDITION OF AGING DURATION | HEIGHT OF POCKET WAVE PER UNIT LENGTH hw [mm/m] | DEGREE OF POCKET WAVE FORMATION |
|---|---|---|---|---|
| A | WITHOUT AGING | | 2.4 | D |
| B | AFTER SKIN-PASS | | 2.3 | D |
| C | (BUT WITH AGING | | 2.0 | D |
| D | BETWEEN COLD | | 2.9 | D |
| E | ROLLING PASSES | | 2.1 | D |
| F | AT 280° C. | | 1.9 | D |
| G | FOR 1 HOUR) | | 2.2 | D |
| H | | | 3.0 | D |
| I | | | 3.0 | D |
| J | | | 1.8 | D |
| K | | | 2.1 | D |

TABLE 4

(COMPARATIVE EXPERIMENT)

| ALLOY | CONDITION OF AGING TEMPERATURE | CONDITION OF AGING DURATION | HEIGHT OF POCKET WAVE PER UNIT LENGTH hw [mm/m] | DEGREE OF POCKET WAVE FORMATION |
|---|---|---|---|---|
| A | 100° C. | 1 h | 1.8 | C |
| B | | | 1.6 | C |
| C | | | 1.7 | C |
| D | | | 1.3 | C |
| E | | | 1.4 | C |
| F | | | 1.5 | C |

TABLE 4-continued

| ALLOY | CONDITION OF AGING TEMPERATURE | CONDITION OF AGING DURATION | HEIGHT OF POCKET WAVE PER UNIT LENGTH hw [mm/m] | DEGREE OF POCKET WAVE FORMATION |
|---|---|---|---|---|
| | (COMPARATIVE EXPERIMENT) | | | |
| G | | | 1.4 | C |
| H | | | 1.2 | C |
| I | | | 1.1 | C |
| J | | | 1.3 | C |
| K | | | 0.9 | B |

TABLE 5

| ALLOY | CONDITION OF AGING TEMPERATURE | CONDITION OF AGING DURATION | HEIGHT OF POCKET WAVE PER UNIT LENGTH hw [mm/m] | DEGREE OF POCKET WAVE FORMATION |
|---|---|---|---|---|
| | (INVENTION) | | | |
| A | 300° C. | 10 min | 0.7 | B |
| B | | | 0.8 | B |
| C | | | 0.6 | B |
| D | | | 0.5 | B |
| E | | | 0.6 | B |
| F | | | 0.5 | B |
| G | | | 0.5 | B |
| H | | | 0.5 | B |
| I | | | 0.3 | B |
| J | | | 0.4 | B |
| K | | | 0.7 | B |

TABLE 6

| ALLOY | CONDITION OF AGING TEMPERATURE | CONDITION OF AGING DURATION | HEIGHT OF POCKET WAVE PER UNIT LENGTH hw [mm/m] | DEGREE OF POCKET WAVE FORMATION |
|---|---|---|---|---|
| | (INVENTION) | | | |
| A | 300° C. | 10 h | 0.2 | B |
| B | | | 0.1 | B |
| C | | | 0 | A |
| D | | | 0.1 | B |
| E | | | 0 | A |
| F | | | 0.1 | B |
| G | | | 0 | A |
| H | | | 0 | A |
| I | | | 0 | A |
| J | | | 0 | A |
| K | | | 0 | A |

TABLE 7

| ALLOY | CONDITION OF AGING TEMPERATURE | CONDITION OF AGING DURATION | HEIGHT OF POCKET WAVE PER UNIT LENGTH hw [mm/m] | DEGREE OF POCKET WAVE FORMATION |
|---|---|---|---|---|
| | (COMPARATIVE EXPERIMENT) | | | |
| A | 700° C. | 1 h | 0.9 | B |
| B | | | 0.7 | B |
| C | | | 1.0 | C |
| D | | | 0.8 | B |
| E | | | 0.9 | B |
| F | | | 1.1 | C |
| G | | | 0.7 | B |
| H | | | 0.6 | B |
| I | | | 0.8 | B |
| J | | | 0.9 | B |
| K | | | 0.9 | B |

It will be appreciated from the results given in Tables 2–7 that, by subjecting the sheet metal of ferritic stainless steel alloy to aging under a proper condition subsequent to skin-pass rolling, the formation of pocket wave can be efficiently suppressed.

Figure 3:
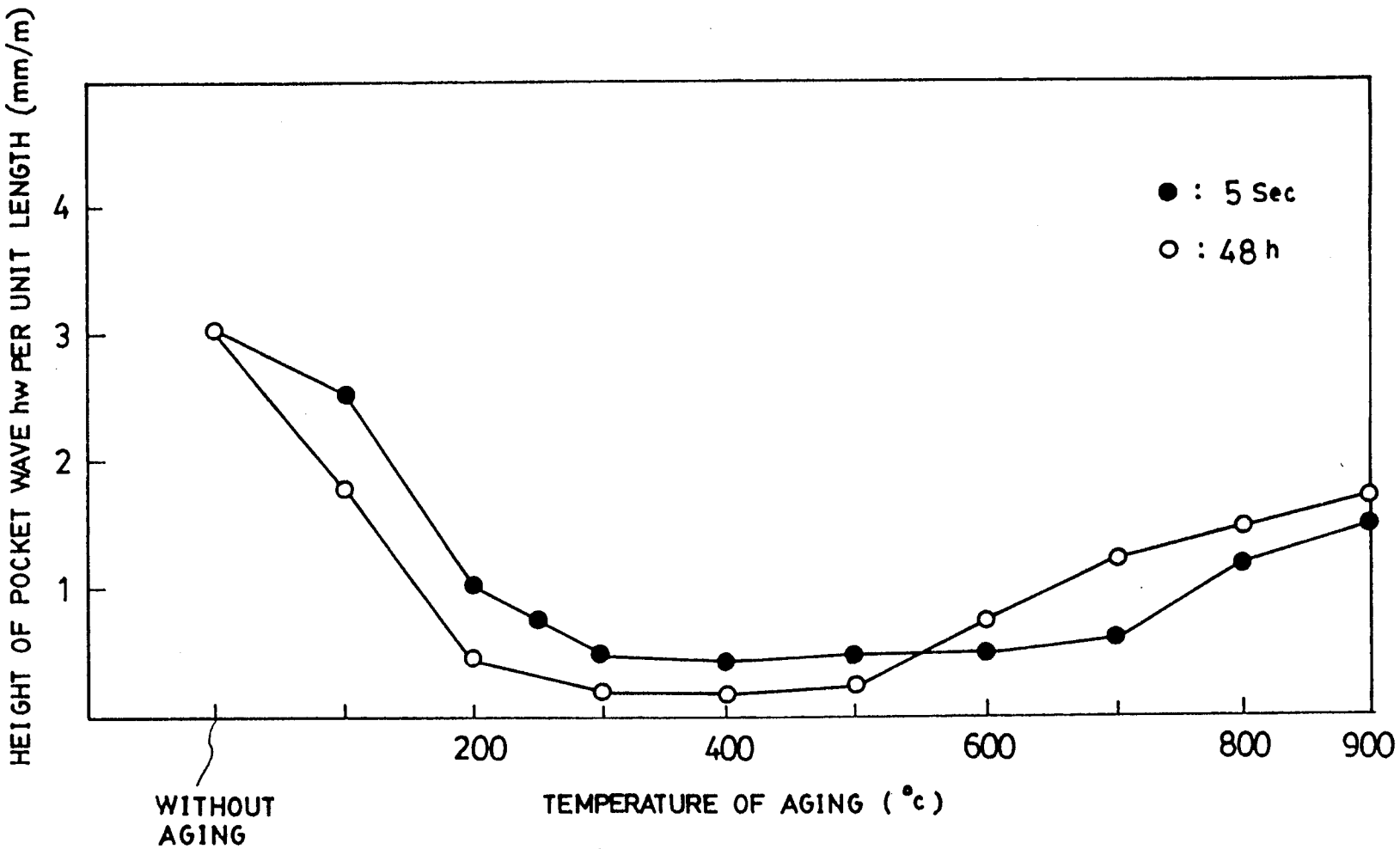
Figure 4:
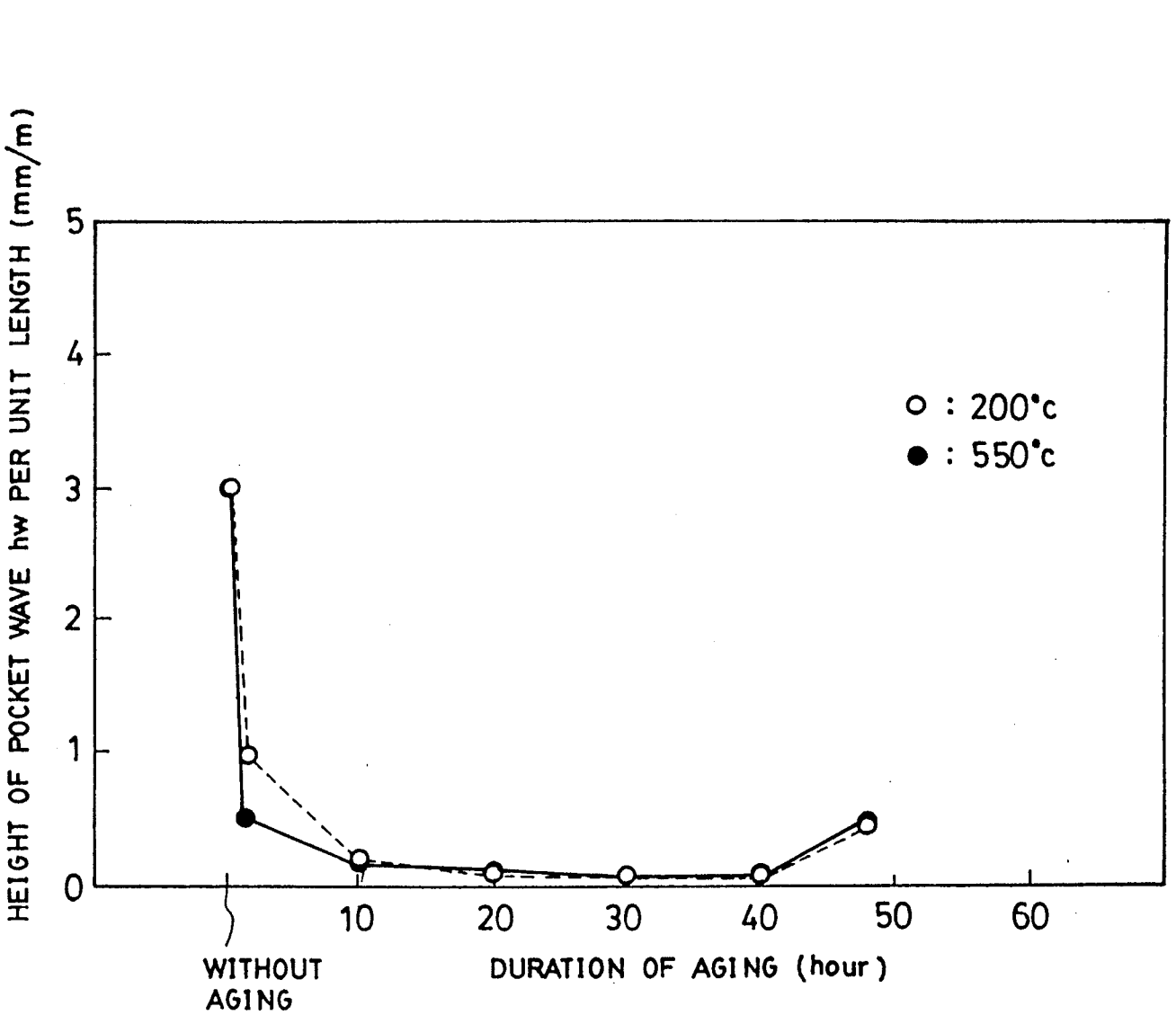

With a view to ascertain the proper aging condition, a further experiment was conducted by varying the duration and temperature of aging. In this experiment, the specimens of sheet metal made from the stainless steel alloy K indicated in Table 1 were used. The results are plotted in the graphs of FIGS. 3 and 4.

EXAMPLE 2

The stainless steel alloy K indicated in Table 1 was used to prepare the specimens of sheet metal. Each specimen of sheet metal was prepared by hot-rolling, annealing, cold-rolling, final annealing and skin-pass rolling, in the same condition as Example 1. Thus, the draft of cold-rolling was 85%. Each sheet metal was then subjected to aging process under varying condition.

After aging and prior to roll-forming, a tensile test piece according to JIS 13B was sampled from each sheet metal along the widthwise direction (C direction) of cold-rolling. A strain gauge of the cross-type was attached to each test piece in such a manner as to detect the amount of tensile strain developed in the direction of tension (longitudinal direction of the test piece) as well as the amount of compression strain developed in the widthwise direction perpendicular to the direction of tension. Each test piece was tested by using an Instron tensile tester. The longitudinal and widthwise strains as measured at the elastic limit reached in the test were read from the recording chart of the tester and the strain ratio was calculated. The results are indicated in Table 8 below, along with the height of pocket wave per unit length and the degree of pocket wave formation as measured and ranked after roll-forming the sheet metal into roofing element. For the purposes of comparison, the results obtained with a specimen prepared without aging is also given in Table 8 in the first data line. In Table 8, the degrees of pocket wave formation are grouped into three ranks and are indicated by symbols which are as follows.

○: Height of pocket wave per unit length is less than 1 mm.

Δ: Height of pocket wave per unit length is equal to or greater than 1.0 mm but is less than 2.0 mm.

X: Height of pocket wave per unit length is equal to or greater than 2.0 mm.

TABLE 8

| CONDITION OF AGING | | STRAIN | HEIGHT OF POCKET WAVE PER UNIT LENGTH | DEGREE OF POCKET WAVE |
|---|---|---|---|---|
| TEMP. | DURATION | RATIO | hw [mm/m] | FORMATION |
| WITHOUT AGING | | 2.1 | 4.0 | X |
| 100° C. | 11.8 h | 2.4 | 3.0 | X |
| 200° C. | 11.8 h | 3.1 | 1.5 | Δ |
| 300° C. | 11.8 h | 3.4 | 0.8 | ○ |
| 400° C. | 11.8 h | 3.5 | 0.4 | ○ |
| 500° C. | 11.8 h | 3.3 | 0.7 | ○ |
| 600° C. | 11.8 h | 3.1 | 1.0 | Δ |
| 700° C. | 11.8 h | 3.1 | 1.1 | Δ |
| 100° C. | 5 sec. | 2.2 | 3.7 | X |
| 200° C. | 5 sec. | 2.5 | 1.9 | Δ |
| 300° C. | 5 sec. | 2.9 | 1.8 | Δ |
| 400° C. | 5 sec. | 3.1 | 1.5 | Δ |
| 500° C. | 5 sec. | 3.3 | 0.9 | ○ |
| 600° C. | 5 sec. | 3.3 | 0.8 | ○ |
| 700° C. | 5 sec. | 3.1 | 1.1 | Δ |

EXAMPLE 3

The stainless steel alloy K indicated in Table 1 was used to prepare the steel slabs. The slabs were hot-rolled at 1,200° C., annealed at 800°-1,100° C., and subjected to cold rolling to prepare steel sheets having a uniform thickness of 0.6 mm. In order to ascertain the effect of the draft of cold rolling upon the strain ratio, the draft of cold rolling was varied as shown in Table 9 by varying the thickness of the slabs after hot rolling. The product was then subjected to final annealing at a temperature of 800°-1,100° C. and thereafter to skin-pass rolling. The draft of skin-pass rolling was about 1%. Then, each specimen was subjected to aging process at 400° C. for 1 hour. After aging, each specimen was subjected to tensile test as in Example 2 to calculate the strain ratio. The results are given in Table 9 below.

TABLE 9

| DRAFT OF COLD ROLLING | DRAFT OF SKIN-PASS | AGING CONDITION TEMPERATURE | AGING CONDITION DURATION | STRAIN RATIO |
|---|---|---|---|---|
| 50% | 1.0% | 400° C. | 1 hour | 3.2 |
| 70% | 1.0% | 400° C. | 1 hour | 3.4 |
| 85% | 1.0% | 400° C. | 1 hour | 3.4 |

From the results given in Table 9, it will be noted that the strain ratio is not affected by the draft of cold rolling.

While the present invention has been described herein with reference to the specific embodiments thereof, it is contemplated that the invention is not limited thereby and various modifications and changes may be made without departing from the scope of the present invention. Also, it should be understood that the term "sheet metal" or "steel sheet" as used in the appended claims is intended to cover not only steel product in the form of a sheet or plate but also what is referred-to in the art as a strip.

We claim:

1. An aged ferritic stainless steel alloy of Cr in an amount of 10–32 wt %, C and N in a total combined amount of 0.005–0.01 wt % and a balance of Fe and unavoidable impurities, the aged ferritic stainless steel alloy having a strain ratio of not less than 2.5.

2. The aged ferritic stainless steel alloy of claim 1 wherein the aged ferritic stainless steel alloy is skin pass rolled.

3. The aged ferritic stainless steel alloy of claim 1 wherein the aged ferritic stainless steel is a substantially channel-shaped roofing element.

4. An aged ferritic stainless steel alloy of Cr in an amount of 10–32 wt %, C and N in a total combined amount of 0.005–0.01 wt %, at least one element selected from the group consisting of 0.2–3.5 wt % of Mo, 0.1–3.0 wt % of Cu, 0.1–0.9 wt % of Nb, and 0.15–1.0 wt %, in total, of Ti, V, Zr, and B, and a balance of Fe and unavoidable impurities, the aged ferritic stainless steel alloy having a strain ratio not less than 2.5.

5. The aged ferritic stainless steel alloy of claim 4 wherein the aged ferritic stainless steel alloy is skin pass rolled.

6. The aged ferritic stainless steel alloy of claim 4 wherein the aged ferritic stainless steel is a substantially channel-shaped roofing element.

* * * * *